US007093716B2

(12) United States Patent
Intini

(10) Patent No.: US 7,093,716 B2
(45) Date of Patent: Aug. 22, 2006

(54) BEND & PEEL MEDICATION DISPENSER

(76) Inventor: Thomas D. Intini, 9270, Recollet Street, Brossard (CA) J4Y 1B9

( * ) Notice: Subject to any disclaimer, the term of this patent is extended or adjusted under 35 U.S.C. 154(b) by 0 days.

(21) Appl. No.: 10/794,453

(22) Filed: Mar. 4, 2004

(65) Prior Publication Data

US 2004/0222122 A1 Nov. 11, 2004

Related U.S. Application Data

(63) Continuation-in-part of application No. 10/017,329, filed on Dec. 14, 2001, now abandoned.

(51) Int. Cl.
*B65D 83/04* (2006.01)

(52) U.S. Cl. ..... 206/532; 206/538

(58) Field of Classification Search ..... 206/528, 206/531, 532, 534, 538, 539, 461, 469, 815, 206/828

See application file for complete search history.

(56) References Cited

U.S. PATENT DOCUMENTS 3,924,747 A * 12/1975 Gerner ..... 206/531
4,011,949 A * 3/1977 Braber et al. ..... 206/532
4,537,312 A * 8/1985 Intini ..... 206/531
4,988,004 A * 1/1991 Intini ..... 206/532
5,339,960 A * 8/1994 Price ..... 206/531
5,944,191 A * 8/1999 Ray et al. ..... 206/532
6,161,699 A * 12/2000 Gartland ..... 206/531
6,598,745 B1 * 7/2003 Bolnick et al. ..... 206/531
2003/0213721 A1 * 11/2003 Jones ..... 206/528
2004/0245145 A1 * 12/2004 Urban ..... 206/531

* cited by examiner

*Primary Examiner*—Mickey Yu
*Assistant Examiner*—J. Gregory Pickett
(74) *Attorney, Agent, or Firm*—Eric Fincham

(57) ABSTRACT

There is provided a child resistant and senior friendly tamper evident package having a blister sheet with blister pockets for medicants, a rupturable foil sealed to a back side of the blister sheet, a layer of paper secured to a back side of the rupturable foil, and a reinforcing layer of a paperboard material being adhered to the paper layer with a portion of the reinforcing layer in registry with the blister pockets not being adhered thereto. There are provided tear strips and tab members to assist in removing the tear strips which delaminate.

5 Claims, 4 Drawing Sheets

BEND & PEEL MEDICATION DISPENSER

This application is a Continuation-In-Part of application Ser. No. 10/017,329 filed Dec. 14, 2001 now abandoned.

FIELD OF THE INVENTION

The present invention relates to a tamper evident, senior friendly child resistant package of the type openable by means of a tear strip.

BACKGROUND OF THE INVENTION

Blister packs are well known in the art and widely used to package individual items such as different forms of medication including tablets, capsules, and the like. Usually, the item or product is accessed through the rear of the blister pack which is provided with a tear strip.

It is desirable to provide for tamper evident packaging which will give a clear indication when the package has been subject to tampering. However, at the same time, the package must be sufficiently easy for the consumer to open. In addition, the package should provide a degree of child resistance to prevent young children from accessing the contents of the blister pack which, as above mentioned, is frequently medication. Indeed, many countries have laws requiring the use of such packaging. Also, as previously mentioned, the package should be sufficiently easy to open. This becomes particularly important when it is understood that the most frequent users of medication are seniors whose physical strength is frequently limited.

A conventional blister package usually comprises a laminate of a blistered layer having article receiving pockets with a foil backing layer. The foil material is rupturable to release the article. While such a package is inherently tamper evident unless the whole foil layer is replaced, it is not very child resistant. U.S. Pat. No. 4,537,312 to Intini shows one improvement over a conventional blister package. This patent describes claims of package in which such a conventional package is enclosed between an outer front layer and an outer back layer sized larger than the conventional package and sealed to one another around their periphery and through apertures in the laminate. Tabs are provided at the edges of the sealed front and back layers connected to tear strips in the back layer, each of which overlies foil covering a blister pocket. At least the tear strips of the back layer made of a material which, on tearing, will leave a stratum still overlying the foil to thereby reinforce it.

A further improvement is shown in Canadian Patent 1,318,294 to Intini which teaches an arrangement similar to the above and wherein there are provided manually gripable tabs for each tear strip, the tabs being free of the rupturable material.

While the above arrangements have been found to be suitable for providing a child resistant package, the package is not necessarily as senior friendly as it might be. Thus, control of the stratum which overlies the film is not achieved in what may have more or less of the stratum depending upon the inherent nature of the paperboard secured thereto.

SUMMARY OF THE INVENTION

It is an object of the present invention to provide an improved child resistant blister pack which is also senior friendly.

According to one aspect of the present invention, there is provided a child resistant and senior friendly tamper evident package, the package comprising a blister sheet having at least one blister pocket projecting from a front side thereof, a rupturable foil sealed to a back side of the blister sheet to form a continuous cover over the blister pocket, the foil being of a thickness and material which can be ruptured to provide access to the pocket, a layer of paper secured to a back side of the rupturable foil, a reinforcing back layer of a paperboard material being adhered to the paper layer, a portion of the reinforcing back layer in registry with the blister pocket not being adhered to the paper layer, and a tear strip formed in the reinforcing back layer, the tear strip being associated with the blister pocket such that the reinforcing layer will delaminate upon opening.

In a greater detail, preferably the blister layer is formed with a number of blister pockets projecting from a front side thereof, to receive a unit dosage of a pharmaceutical product as is well known in the art. The sheet may comprise a normally rectangular continuous blister sheet of a flexible clear film which cannot be easily torn or ruptured. Such a film may be, for example, a vinyl thermoplastic film usually having a thickness in excess of 10 mil.

The rupturable film sealed to the back side of the blister sheet is well known in the art and accordingly, may be selected from known materials. Typically, such rupturable foils are of an aluminum material having a thickness in the range of 1 mil and which may be joined to the blister sheet by conventional heat sealable coatings which are well known in the art.

The layer of paper secured to the back side of the rupturable foil is designed to reinforce the rupturing strength of the rupturable foil while maintaining a sufficient ease for the package to be deemed senior friendly. Preferably, the paper layer would comprise paper having a weight of between 13 lbs to 17 lbs.

The reinforcing layer is preferably a paper product such as a paperboard. The tear strip may be defined by parallel lines of perforations or slots in the reinforcing layer to form longitudinal tear lines defining the strip. One end of the strip may end at the edge of the reinforcing layer and at the other end it may be provided with a tab. The tab may be rectangular and integral with the strip at one tab edge while the other three tab edges may be defined by cuts through the reinforcing layer. To facilitate bending the tab outwardly from the tear strip and matrix without disturbing the tear strip, a score line may be provided between tab and tear strip.

The paperboard layer is adhered to the layer of paper, but only at certain locations. In this respect, the paperboard layer is not adhered to the paper layer at the central portion of the area overlying the blister pocket. By so doing, delamination will occur at the outer edges while at the inner portion, only the paper layer and the foil layer will remain once the tear strip has been removed.

According to a further aspect of the present invention, there is also provided a method for manufacture of a child resistant and senior friendly tamper evident package.

According to a further aspect of the present invention, there is provided a method of forming a child resistant and senior friendly tamper evident package, the method comprising the steps of providing a blister sheet having a front surface and a rear surface and having a plurality of blister pockets projecting from a front side thereof, filling the blister pockets with a medicant, sealing a rupturable foil to a back side of the blister sheet to form a continuous cover over the blister pockets, adhering a layer of paper to a back side of the rupturable foil, and placing a reinforcing back layer of a paperboard material over the layer of paper, and securing the back layer to the paper layer and selected areas while leaving areas of the back reinforcing layer in registry with the blister pockets in a non-adhered condition. A data layer can also be sealed to the plastic side of the blister packaging or sealed to the reinforcing back layer around the outer edge of the blister.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
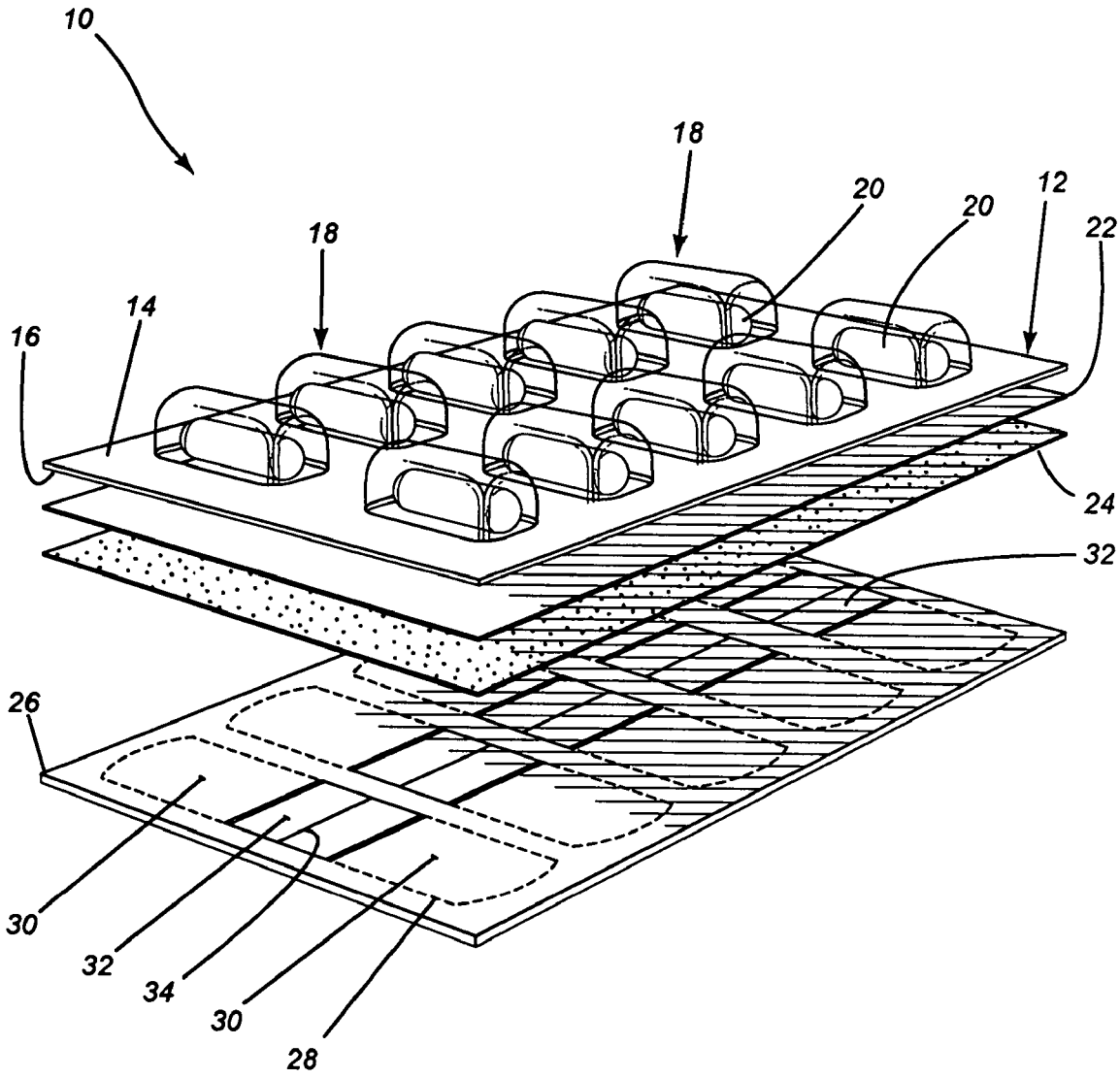
FIG. 1 is an exploded view illustrating a child resistant senior friendly tamper evident package according to the present invention.
Figure 2:
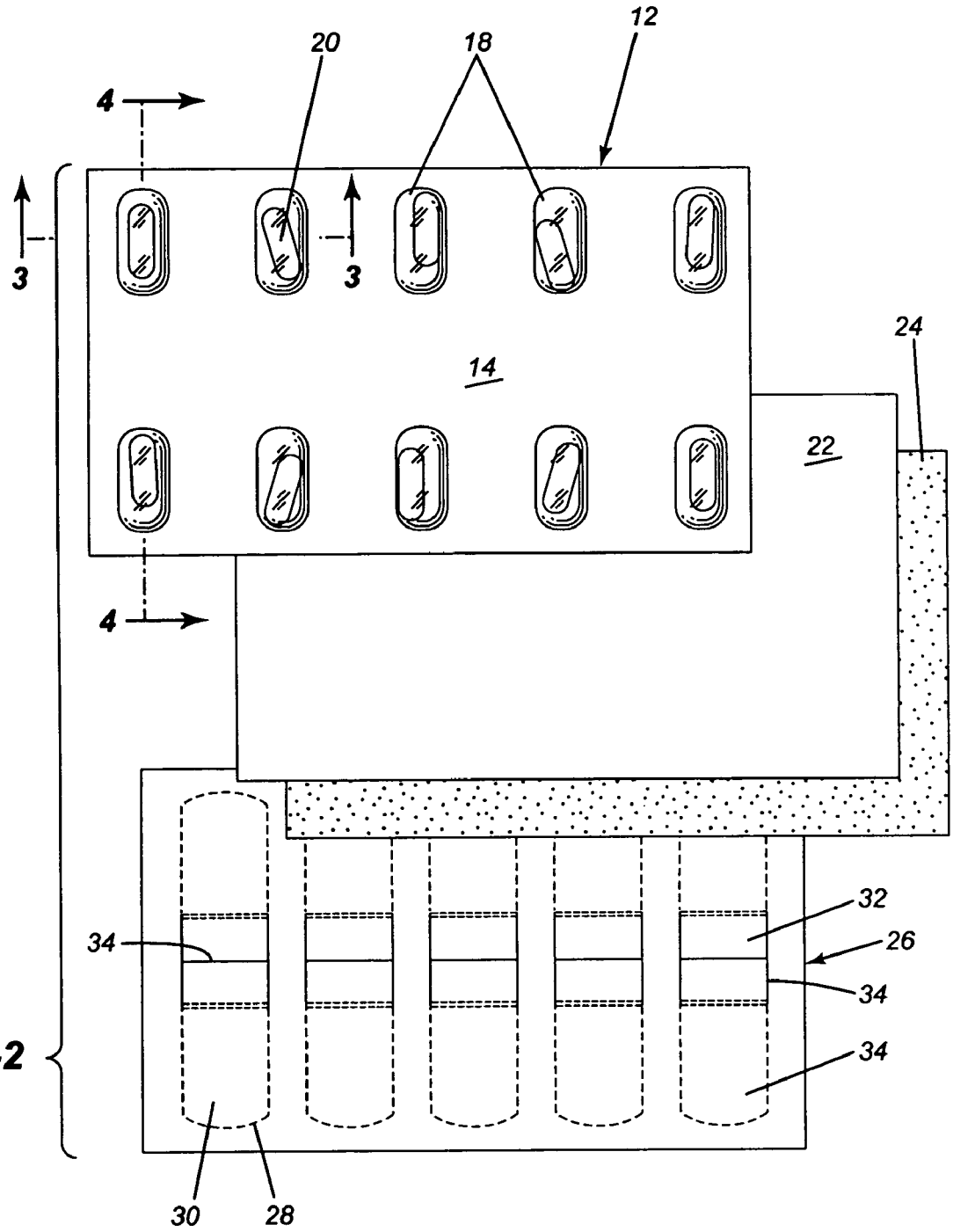
FIG. 2 is a further exploded top view of the package of the present invention.
Figure 3:
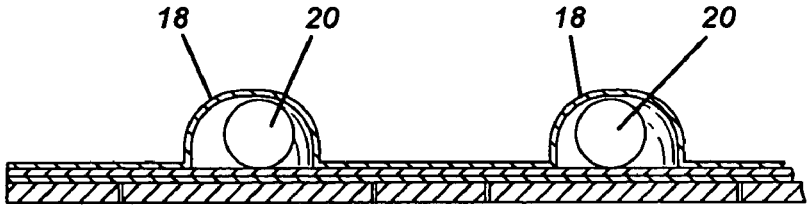
FIG. 3 is a cross sectional view taken along the lines 3—3 of FIG. 2.
Figure 4:
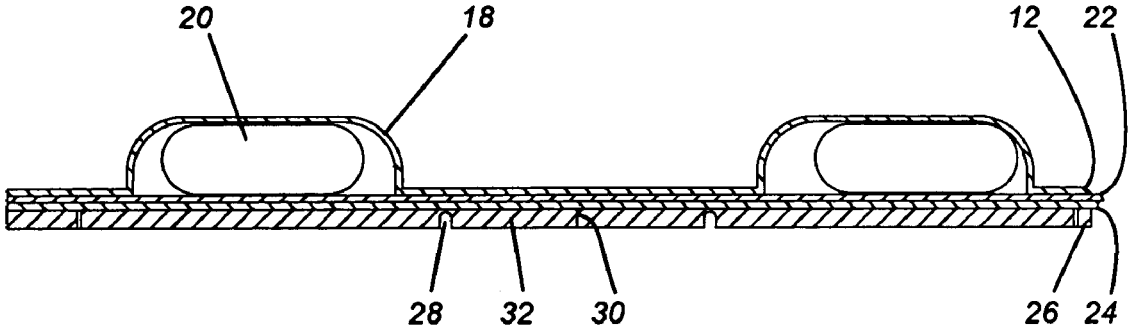
FIG. 4 is a cross sectional view taken along the lines 4—4 of FIG. 2.

Referring to the drawings in greater detail and by reference characters thereto, there is illustrated a child resistant senior friendly tamper evident package which is generally designated by reference numeral 10.

Package 10 includes a blister layer 12 which has a front side 14 and a rear or back side 16. Pockets 18 are formed in blister layer 12 and pockets 18 extending outwardly from the front side 14 in a conventional manner. Blister layer 12, as previously discussed, is preferably formed of a clear plastic material.

A foil layer 22 is adhered to the rear or back side 16 of blister layer 12 in a conventional manner.

According to the present invention, there is provided a paper layer 24 which is then adhered to foil layer 22 to act as a reinforcement therefore.

Finally, there is provided a reinforcing paperboard layer 26 which is selectively adhered to portions of paper layer 24. In this respect, paperboard layer 26 is not adhered to paper layer 24 in the central area in registry with pockets 18 nor is it adhered in the area of tabs as will be discussed hereinbelow. However, paperboard layer 26 is adhered to paper layer 24 about the periphery of pockets 18.

Formed in reinforcing paperboard layer 26 are a plurality of slits or lines for weakening to thereby define a plurality of tear strips 30, each tear strip being associated with a respective pocket 18. Each tear strip 30 has a tab 32 at one end thereof. Slits 34 define tabs 32 and which slits 34 extend completely through the paperboard layer such that the tabs may be easily lifted.

Figure 5:
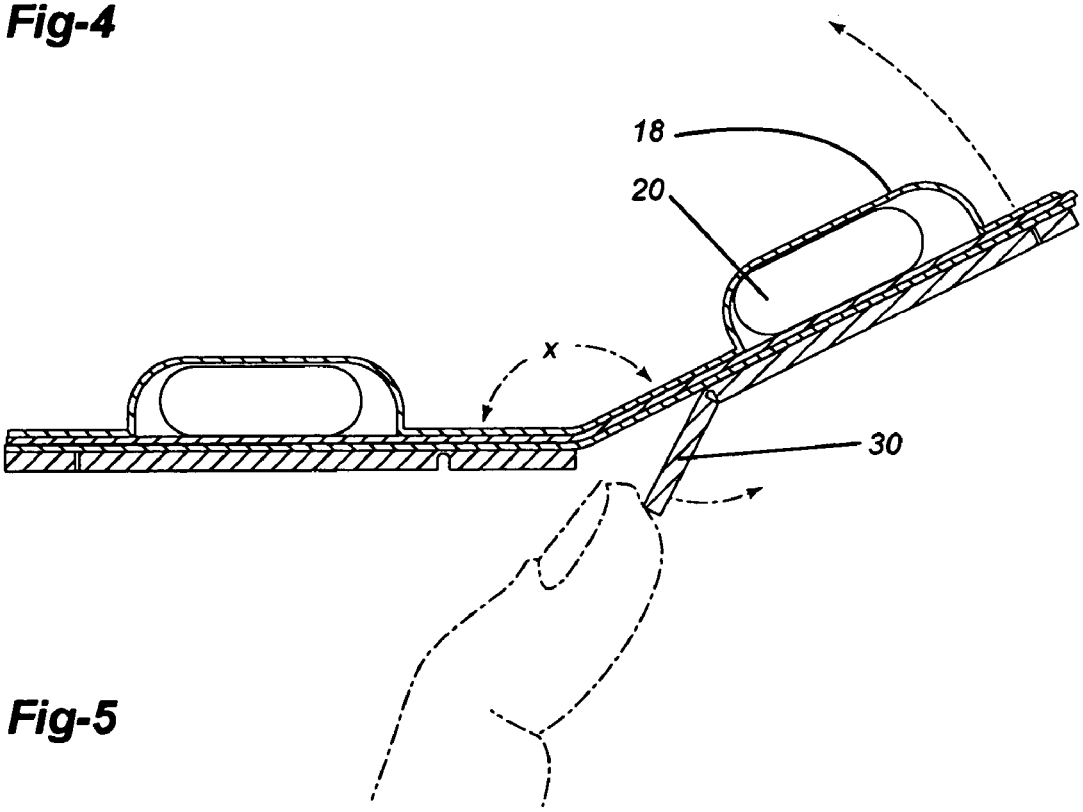
FIG. 5 is a cross sectional view illustrating opening of the package to provide access to one of the compartments.
Figure 6:
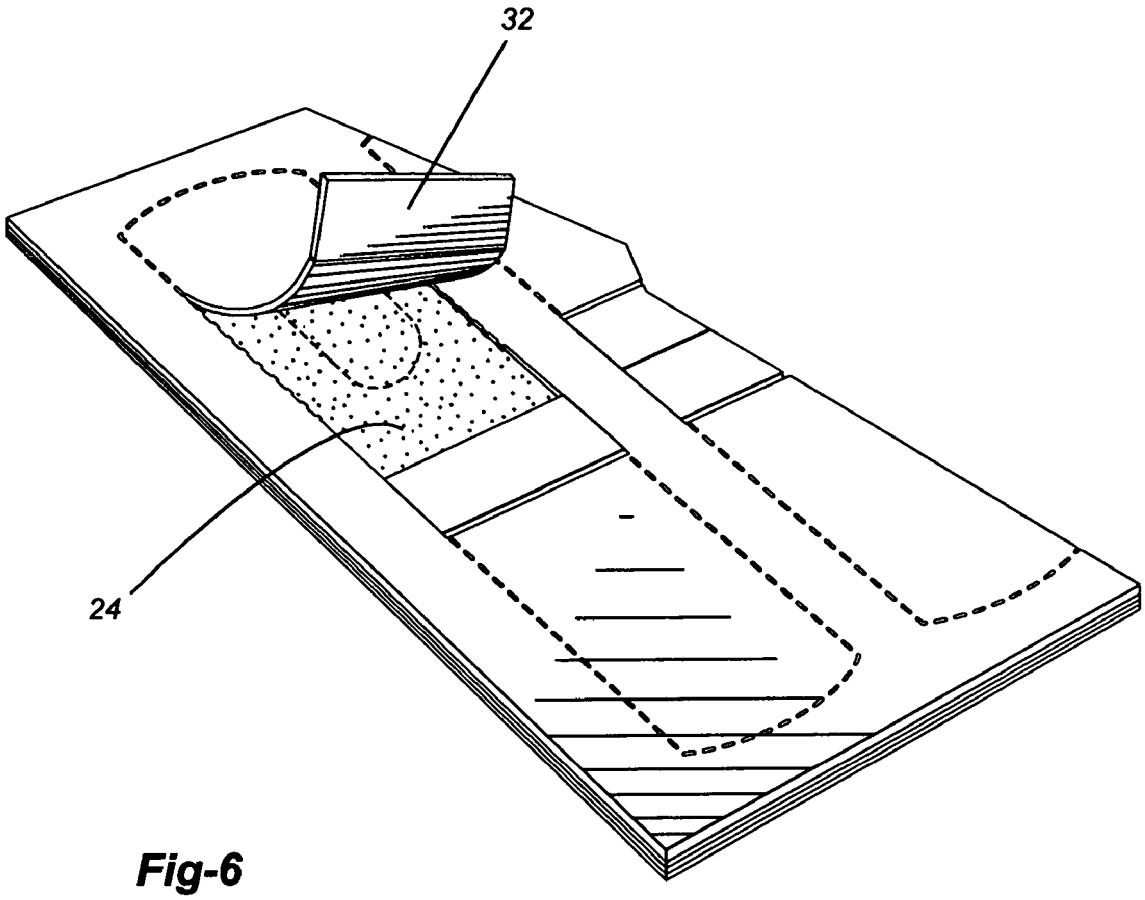
FIG. 6 is a partial rear view of the package showing the opening of one of the tear strip members to provide access to a pocket.

As shown in FIGS. 5 and 6, a tab 32 may be lifted and then pulled in a conventional manner. In so doing, reinforcing paperboard layer 26 delaminates while paper layer 24 and foil layer 22 remain to cover the pocket 18. As will be appreciated, there does remain a delamination of paperboard layer 26 about the periphery of the area covering pocket 18. However, in the essential portion, only the paper layer 24 and the foil layer 22 remain. As such, access to pocket 18 remains sufficiently difficult for a child while an adult, even with limited physical strength, is able to access the same.

It will be understood the above described embodiment is for purposes of illustration only and that changes or modifications may be made thereto without departing from the spirit and scope of the invention.

I claim:

1. A child-resistant and senior friendly tamper evident package, said package comprising a blister sheet having at least one blister pocket projecting from a front side thereof;

a rupturable foil sealed to a back side of said blister sheet to form a continuous cover over said blister pocket, said foil being of a thickness and material which can be ruptured to provide access to the pocket;

a paper layer secured to a back side of said rupturable foil;

a reinforcing layer of a paperboard material, said reinforcing layer being adhered to said paper layer, a portion of said reinforcing layer in registry with said at least one blister pocket not being adhered to said paper layer; and a tear strip formed in said reinforcing layer, said tear strip being associated with said at least one blister pocket such that said reinforcing layer will delaminate internally leaving a portion of said paper board material adhered to said paper layer within the periphery of said blister pocket.

2. The package of claim 1 wherein said package has a plurality of blister pockets projecting from a front side thereof, and a plurality of tear strips, a tear strip being associated with each of said pockets.

3. The package of claim 1 wherein said blister sheet is formed from a polyvinyl chloride sheet.

4. The package of claim 1 wherein said paper layer comprises paper having a weight of between 13 lbs –17 lbs.

5. The package of claim 4 wherein each of said blister pockets contains a single dose of medicant.

* * * * *